US008028826B1

(12) United States Patent
Woo et al.

(10) Patent No.: US 8,028,826 B1
(45) Date of Patent: Oct. 4, 2011

(54) STORAGE SYSTEM FOR 25MM IM CARTRIDGES

(75) Inventors: Timothy Woo, Flushing, NY (US); Leon Moy, Flushing, NY (US); Alan N. Cohen, Wharton, NJ (US); Daniel Lee Prillaman, Flushing, NY (US); Christina Morales, Mine Hill, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 16 days.

(21) Appl. No.: 12/696,265

(22) Filed: Jan. 29, 2010

(51) Int. Cl.
*F42B 39/00* (2006.01)

(52) U.S. Cl. ..... 206/3; 206/589; 206/593; 224/931

(58) Field of Classification Search ..... 206/3, 443, 206/588, 589, 590, 592, 593; 86/23, 38, 86/44, 31; 42/49.01, 50; 224/931
See application file for complete search history.

(56) References Cited

U.S. PATENT DOCUMENTS

| | | | | | |
|---|---|---|---|---|---|
| 3,153,500 | A | * | 10/1964 | Pachmayr et al. | 224/245 |
| 3,593,873 | A | * | 7/1971 | Vonk | 220/507 |
| 3,596,557 | A | * | 8/1971 | Henshaw | 89/33.2 |
| 4,757,894 | A | * | 7/1988 | Schreckenstein | 206/3 |
| 4,811,836 | A | * | 3/1989 | Minneman | 206/3 |
| 4,903,575 | A | * | 2/1990 | Capawana | 89/34 |
| 5,719,348 | A | * | 2/1998 | Bill et al. | 86/38 |

FOREIGN PATENT DOCUMENTS

FR 2623611 A1 * 5/1989

OTHER PUBLICATIONS

DTIC "Technical Report ARAED-TR-93002" dated Jun. 25, 1993.*

* cited by examiner

*Primary Examiner* — David Fidei
(74) *Attorney, Agent, or Firm* — Henry S. Goldfine

(57) ABSTRACT

An improved 25 mm linked cartridge IM ammunition storage system, using existing ammunition cans, that simplifies the design of the storage system, and utilizes standoffs to separate the base of each cartridge from the ends of the ammunition can—thereby allowing the cartridges base IM venting system to vent properly, avoiding pressure build-up, and reducing the risk of explosion or detonation of the propellant.

3 Claims, 3 Drawing Sheets

STORAGE SYSTEM FOR 25MM IM CARTRIDGES

STATEMENT REGARDING FEDERALLY SPONSORED RESEARCH OR DEVELOPMENT

The invention described herein may be made, used, or licensed by or for the United States Government for Government purposes without the payment of any royalties therefore.

BACKGROUND OF THE INVENTION

1. Field of the Invention

The present invention is generally directed to an improved storage system for belts of 25 mm insensitive munition (IM) cartridges using existing ammunition cans, and, more particularly, to such a storage system that enhances the IM feature and is simplified.

2. Description of Related Art

Currently, 25 mm linked cartridges are stored in ammunition cans, such as the U.S. Army's PA125 ammunition cans, which hold thirty such linked cartridges arranged in two belts of 15 cartridges each, each belt is held in a retaining plate spaced away from each end of the ammunition can by a thin foam pad, with one retaining plate holding its cartridges vertically within the ammunition can and the other retaining plate holding its cartridges in an opposed, i.e. inverted, position within the ammunition can. There is a separator assembly located between the retaining plates, this separator assembly has a lower set of cavities, each of which rests on the shoulders of one of the two sets of cartridges, so as to fit snuggly, i.e. tightly, hold the middle tapered section of each cartridge therein; whereby, in conjunction with the cavities in the retaining plate, each cartridge is held in place between these two locations. There is also an upper set of cavities within the separator assembly that loosely surrounds the tip of each cartridge. The current retaining plates are generally rectangular, in the form of the internal configuration of standard ammunition cans, and contain a series of cylindrical cavities to support the 25 mm cartridges in a close arrangement. Two sets of linked belts of 25 mm cartridges, when held by the combined retaining plate and the separator assembly forms a composite interlocked assembly which fits snuggly into the ammunition can, thereby minimizing potential movement of the cartridges when the ammunition can is jostled during handling and minimizing the overall size of the ammunition can itself, i.e. for logistic purposes. Obviously, this current system utilizes a number of separate parts, i.e. two foam pads, two retaining plates and one separator assembly—which makes it more complicated, more costly, and more difficult to use on the battlefield.

As stated above, there are a set of thin, ¼ inch, foam backings which separate the base of each retaining plate from the respective top and bottom ends of the ammunition can. The base of each of the 25 mm linked cartridges extends through its respective retaining plate and resting on this ¼ inch foam backing. This arrangement provides that the ¼ inch foam backing will fill any gap between each retaining plate and the respective top or bottom of the ammunition can by which it is positioned; thereby, tending to further minimize any jostling effects.

Newer munitions are designed to minimize any violent (explosive) response when subjected to unintended stimuli during transportation and storage, such munitions are generally known as insensitive munitions or simply as, IM. Generally, such IM type cartridges are provided with means to vent themselves such that when unintentionally subjected to heat or kinetic energy for an accidental fire or the result of enemy action. Such venting avoids pressure build-up if the propellant is ignited and the propellant will then tend to burn rather than explode. In the case of new IM cartridges, such pressure relief can be accomplished by safety devices which will automatically vent any pressure build-up when the temperature approaches the auto-ignition temperature of the propellant within the cartridge. Such venting of the propellant is generally accomplished through the base of the cartridge—considering the location of the propellant adjacent thereto. Unfortunately, any current 25 mm linked cartridges stored as detailed above, i.e. tightly contained in ammunition cans with each cartridge directly resting on a ¼ foam backing pad, will not be able to be vented through its base due to the foam pad.

There is clearly a need in the art for a storage system with a new retaining plate/separator assembly configuration for storing 25 mm linked cartridges in existing ammunition containers that does not impede effective venting from the base of the IM cartridge during an unforeseen heat/kinetic energy event and for a storage system which is simpler and therefore less costly and easier to use by the soldier under battlefield conditions

SUMMARY OF THE INVENTION

Objectives of the present invention address the needs detailed above, including providing a means for effectively allowing the venting from the base of any IM 25 mm linked cartridges—venting which prevents the explosion/detonation of the cartridge when subjected to any unforeseen heating/kinetic event during its storage. Objectives which include providing such means of venting, when the 25 mm linked cartridges are tightly packed for storage in current 25 mm linked ammunition cans, held between a set of retaining plates and a separator assembly, which system holds the 25 mm linked ammunition in the exact same orientation as current such retaining plates—such that, the 25 mm linked ammunition can be handled and loaded by any soldier as that soldier is trained to handle and load current 25 mm linked ammunition.

To realize these objectives, the retaining plate/separator system of the current invention replaces the currently used retaining plates and the ¼ inch foam pads with two new, inventive plates. Each new, inventive retaining plate has a series, i.e. a plurality, of bottom elastomeric or rubber supporting standoffs, preferably small cylindrical shaped elements, that support that plate about ⅜ inch from the adjacent, respective, top or bottom of the ammunition can. Further each cylindrical cavity for holding a 25 mm linked cartridge, within each retaining plate, is provide with a thin supporting lip, which is preferably about ⅛ inch about the lower periphery of each cylindrical cavity, such that the 25 mm cartridges will rest thereon and will not pass though the retaining plate as in the prior art. Therefore, other than the thin lip that each cartridge rests, the bottom of each IM cartridge case is uncovered and exposed below each retaining plate, such that the IM cartridge is able to vent below each retaining plate into the open space created by and between the pads. Currently, means are known, whereby the hot gases venting between the standoffs, can themselves be vented out of the ammunition container, such as by use of a lower melt temperature material for an adjacent portion of the ammunition can.

As stated, the present invention allows 30 25 mm linked IM cartridges to be stored in the currently utilized ammunition containers, such as the PA125 ammunition cans. As the prior art ¼ inch foam pads have been replaced by the elastomeric or rubber ⅜ inch supporting standoffs below each retaining plate of the new invention, the separator assembly of the new invention has been reduced in height by ¼ of an inch. The reduction in height simply involves a ½ inch reduction of the length of the columns which separate the upper and lower sets of cavities within the separator assembly—otherwise this new separator assembly is identical to that of the prior art.

The other objects, features and advantages of the present invention will become more apparent in light of the figures contained herein and the following detailed description thereof.

DETAILED DESCRIPTION OF A PREFERRED EMBODIMENT OF THE INVENTION

Figure 1:
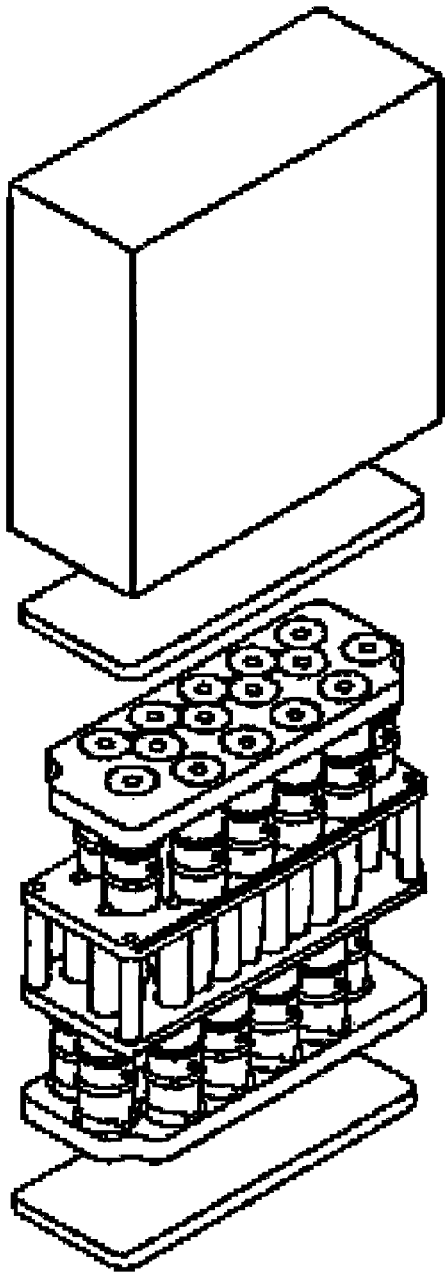
Fig. 1 Prior Art
FIG. 1 is an exploded assembly view of a current art ammunition can containing two sets of 15 linked 25 mm cartridges therein.
Figure 2:
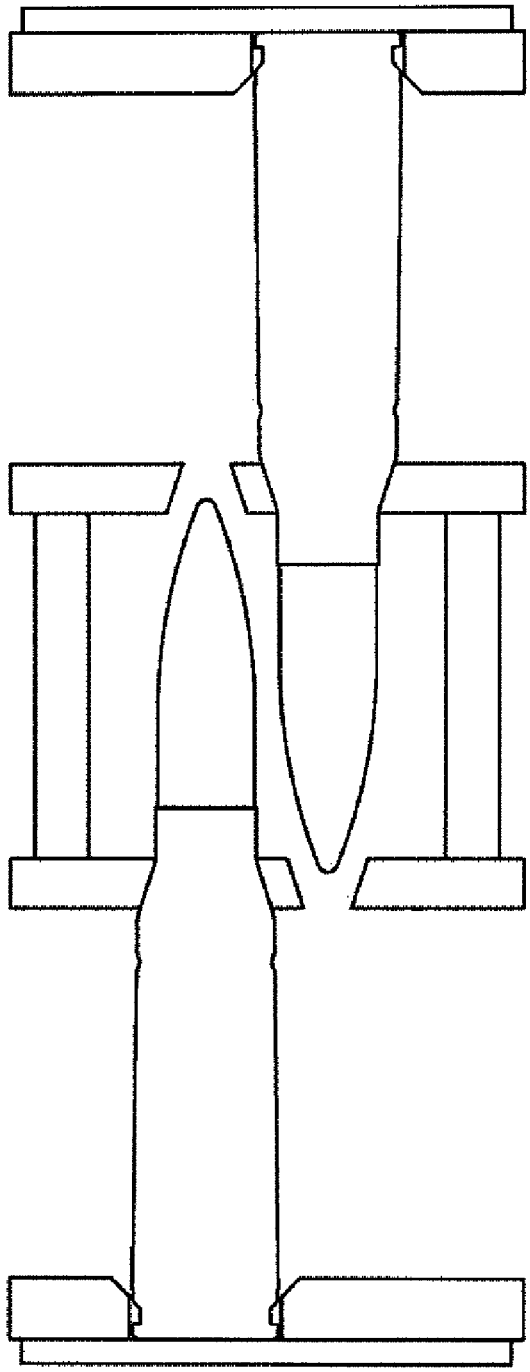
FIG. 2 Prior Art
FIG. 2 an elevation cross-sectional view of the storage system of the prior art, showing two (2) 25 mm cartridges that are held in position by a set of current, opposed retaining plates; ¼ inch foam pads are shown on the top of the top retaining plate and on the bottom of the bottom retaining plate; and two cartridges are shown as being separated by a current art separator assembly—the surrounding ammunition can and the linkage belt between adjacent like oriented cartridges, are not shown.
Figure 3:
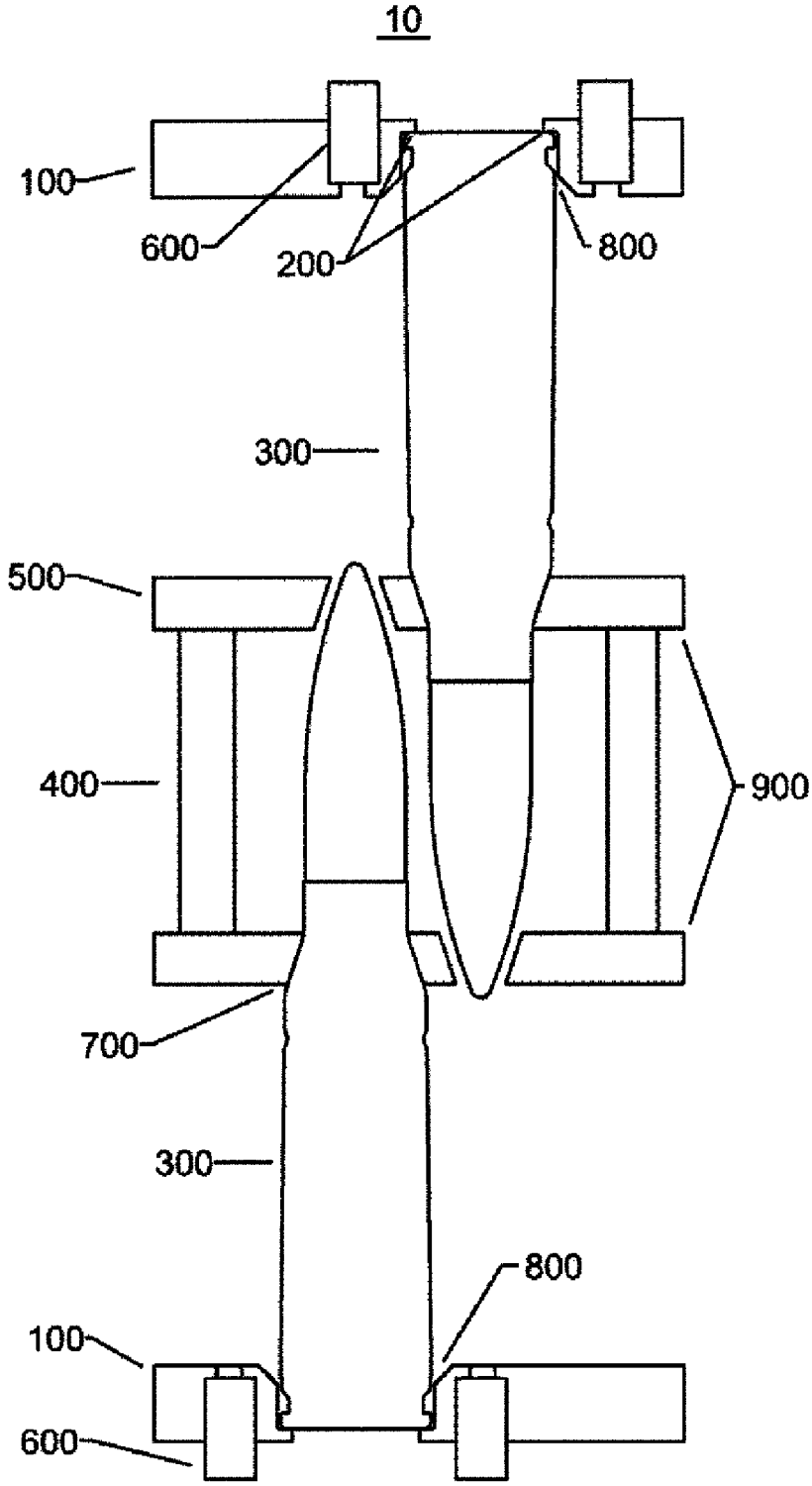
FIG. 3 is an elevation cross-sectional view showing the new retaining plates and separator assembly of the present invention—corresponding to the prior art shown in FIG. 2.

As shown in FIGS. 1 and 2, current art retaining plates, utilized in 25 mm linked cartridge ammunition cans, allow the 25 mm cartridges to pass through, such that each 25 mm cartridge is supported on a thin, ¼ inch, foam pad located along the bottom or top of the respective 2 opposed retaining plates. As discussed above, this intimate, flush interface between the bottom of each cartridge and the thin, ¼ inch, foam pads does not allow any venting from the bottom of each 25 mm cartridge (therefore, defeating the IM venting feature of new IM type 25 mm cartridges, which feature reduces pressure within each cartridge, in the event the propellant therein is accidently or in a conflict situation ignited, to avoid an explosion or detonation). In contrast, as shown in FIG. 3, which shows a storage system 10, comprised of a set of 25 mm retaining plates 100 and separator assembly 500 of the current invention, the retaining plates 100 are supported by and spaced away from the adjacent ends of the ammunition can (not shown in FIG. 3), by a plurality of elastomeric or rubber supporting standoffs 600—the ¼ inch foam pads are not necessary or utilized (simplifying the design and thereby providing easier/quicker use on the battlefield). Further, in the present invention, the 25 mm cartridges 300 are supported within each cylindrical cavity 800 in which each cartridge sits by a thin supporting lip 200 about the lower periphery of each cylindrical cavity 800. This support, about the periphery of the base of each cartridge 300, leaves most of the base uncovered, such that if the propellant were to ignite, for whatever reason, the hot gasses generated by that ignition could escape though whatever IM type feature was used in the particular cartridge 300, unimpeded though the base of the cartridge, unimpeded out the bottom of the open cylindrical cavity 800 in which the cartridge sits, and out into the respective ends of the ammunition can (unimpeded by the spaced out supporting standoffs 600). And, as stated above, there are known features by which the hot gases can then be vented from the ammunition can itself.

As was generally described above, and as is shown in FIG. 3, the separator assembly 500 is substantively identical to that of the prior art; except, that the separator columns 400 have been shortened to compensate for the extra space required by the height of the supporting standoffs 600. As the height of the supporting standoffs 600 is preferably ⅜ or ⅛ more than the ¼ in foam pads of the prior art—the height of the separator columns must be reduced accordingly by about ¼ inch (i.e. ⅛ inches times 2, for the 2 sets of supporting pads 600). Additionally, the thin supporting lip 200 about the lower periphery of each cylindrical cavity 800 supports the base of the cartridge an additional ⅛ inch about the prior art—the height of the separator columns must be reduced an additional ¼ inch, for a total of about ½ inch.

The separator assembly 500 of the present invention is provided with two parallel fixtures 900, separated by a set of spacing columns 400, each fixture 900 having a set of generally cylindrical cavities 700 that are tapered to snuggly fit about the shoulder of each cartridge 300. This snug fit about the tapered shoulder of each cartridge 300 and fit of the base of the cartridge 300, within the cylindrical cavity 800 in the retainer plate 100, resting on the thin peripheral supporting lip 200, holds the cartridge 300 in the desired alignment between each retaining plate 100 and separator assembly 500 system 10.

It is preferred that the retaining plate 100 and separator assembly 500 of the present invention be manufactured of fiberglass or other heat resistant plastic material that can easily be molded in to the desired shape.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. An improved storage system for tightly packing two cartridge belts of 25 mm caliber linked IM cartridges in a standard 25 mm ammunition can, the storage system comprising:

(a) a first and a second 25 mm caliber ammunition belt, each belt containing a plurality of 25 mm caliber cartridges, each of which 25 mm caliber cartridges has a base end and opposed thereto a tip end and between the base and tip ends, a tapered ogive segment;

(b) a standard 25 mm ammunition can, which can has a top, and opposed and generally parallel thereto a bottom;

(c) a first retainer plate having a top side and opposed thereto a bottom side, with a plurality of cylindrical cavities extending from said bottom side to said top side;

(d) said first retainer plate being located parallel to and adjacent to the bottom of said ammunition can with the bottom side of the first retainer plate being the side thereof closest to the bottom of said ammunition can;

(e) the bottom side of said first retainer plate being spaced away from the bottom of said ammunition by a plurality of standoffs, which standoffs are secured to and extend from the bottom side of said first retainer plate, thereby creating a region of free space therebetween;

(f) a thin lip extending from the periphery of each of said cavities (800), partially into and towards the center of each of said cavities, each lip having a portion thereof located co-planar with the bottom side of said first retainer plate;

(g) a separator assembly, located generally midway between the top and bottom of the ammunition can and relatively parallel with respect to said top and bottom;

(h) the separator assembly having a two separator fixtures, a first separator fixture, parallel to and nearest the bottom of said ammunition can, and the second separator fixture parallel to said first separate fixture and nearest the top of said ammunition can;

(i) said second separator fixture being spaced away from said first separator fixture by a plurality of separator columns;

(j) each separator fixture having a plurality of pairs of aligned tapered cavities therethrough, the first of the pair of tapered cavities being located in the first separator fixture, and configured to accept, conform to, and hold the tapered ogive segment of each cartridge;

(k) the second of the two tapered cavities, located in the second separator fixture, is configured to accept, conform to, and hold the tip of each cartridge;

(l) wherein, the base end of each cartridge within the first 25 mm cartridge belt rests upon the lip extending about the periphery of one of the cylindrical cavities within said first retainer plate, such that each cartridge extends out of said cylindrical cavity and the base of each such cartridge is generally parallel to the base of said ammunition can, and the tip end of each cartridge extends towards the top of said ammunition can;

(m) wherein each of the plurality of cartridges within the first 25 mm cartridge belt extending from said cavities in said first retainer plate, extends through and into said separator assembly, the tapered ogive section of said cartridge secured within said first separator fixture and the tip of said cartridge secured within said second separate fixture;

(n) a second retainer plate, having a bottom and a top side, with a plurality of cylindrical cavities therethrough, each such cavity having a lip extending therein, upon which lip each of the cartridges held within the second belt rests and extends, all exactly as described with regard to said first retainer plate above, except that the bottom side of said second retainer plate is generally parallel with and spaced away from the top of said 25 mm ammunition can, and the tip end of each cartridge therein extends towards the bottom of said ammunition can;

(o) the bottom side of said second retainer plate being spaced away from the top of said ammunition by a plurality of standoffs, which standoffs are secured to and extend from the bottom side of said second retainer plate, thereby creating a region of free space therebetween;

(p) wherein, the cartridges extending from the second retainer plate are offset from the cartridges extending from the first retainer plate, such that the cartridges whose tip end extends towards the top of said ammunition can does not interfere with the cartridges whose tip end extends towards said bottom of said ammunition can;

(p) the cartridges extending from the second retainer plate, extend to and are held by a pair of aligned tapered cavities, within each separator fixture, within the separator assembly, in a fashion identical to that as the cartridges extending from the first retainer plate are held within the separator assembly, expect as stated, in an offset mirror image thereof;

(q) whereby, if there is an unintended ignition of any cartridge within either of said cartridge belts, the resulting build-up of hot propellant gases generated thereby, can freely vent from the base end of each cartridge into the region of free space between the base end of each retainer plate and the respective adjacent top or bottom of the ammunition can.

2. The improved storage system for tightly packing two belts of 25 mm caliber linked "insensitive munitions" cartridges in a standard 25 mm ammunition can of claim 1, the improvement including selecting the material to manufacture the retaining plate and separator assembly of fiberglass and other heat resistant plastic material.

3. The improved storage system for closely packing two belts of 25 mm linked caliber IM cartridges in a standard 25 mm ammunition can of claim 1, wherein the ammunition can is a equivalent in size and configuration to the U.S. Army model PA125 ammunition can.

* * * * *